United States Patent [19]

Kohno

[11] Patent Number: 4,501,069

[45] Date of Patent: Feb. 26, 1985

[54] CUTTER FOR WALL PAPERS

[75] Inventor: Seiji Kohno, Sagamihara, Japan

[73] Assignee: Kabushiki Kaisha Tajima Seisakusho, Tokyo, Japan

[21] Appl. No.: 554,961

[22] Filed: Nov. 25, 1983

[30] Foreign Application Priority Data

Sep. 22, 1983 [JP] Japan ..... 58-145878[U]

[51] Int. Cl.[3] ..... B26B 1/08

[52] U.S. Cl. ..... 30/293; 30/294

[58] Field of Search ..... 30/293, 294, 286, 289, 30/162; 7/105

[56] References Cited

U.S. PATENT DOCUMENTS

| | | | |
|---|---|---|---|
| 2,770,879 | 11/1956 | Seymour | 30/293 |
| 2,889,623 | 6/1959 | Baker | 30/294 |
| 3,726,010 | 4/1973 | Yokoyama | 30/293 |
| 4,077,124 | 3/1978 | Christmann | 30/294 |
| 4,322,885 | 4/1982 | Osada | 30/162 |
| 4,408,396 | 10/1983 | Scholl | 30/294 |

FOREIGN PATENT DOCUMENTS 143500 10/1979 Japan .

*Primary Examiner*—Jimmy C. Peters

*Attorney, Agent, or Firm*—Young & Thompson

[57] ABSTRACT

A cutter for wall papers comprises a triangular grip and a sheath embedded therein for slidably holding a cutting blade. According to the invention, a base of the triangular grip defines a slide edge extending at an acute angle with the cutting blade and having a V-shaped cross-section symmetrical with respect to a plane containing a cutting edge of the cutting blade, thereby uniformly trimming edges of the papers extending on a baseboard without requiring rulers to obtain aesthetical workmanship of interior finish work in buildings.

8 Claims, 9 Drawing Figures

CUTTER FOR WALL PAPERS

BACKGROUND OF THE INVENTION

1. Field of the Invention

This invention relates to a cutter for wall papers or cloths, which is convenient for newly or renewedly attaching the wall papers to walls for interior finish work of buildings.

2. Description of the Prior Art

The term "wall papers" used herein means not only papers to be attached to walls but also other flexible thin sheets for the same purpose such as cloths, fabrics, unwoven fabrics, vinyl resin sheets and the like.

The term "baseboard" used herein is intended to include a cross piece extending along a boundary between a wall and a floor and having a surface substantially perpendicular to a wall surface to which a wall paper is attached, and further includes a cross piece substantially horizontally extending along a boundary between a wall and a ceiling or a vertical member along a corner between two walls perpendicular to each other.

In such an interior finish work, it is absolutely necessary to attach a wall paper to a wall in intimate contact with each other all over the walls, while it is further needed to arrange uniformly edges of the papers and extra extending portions of the papers relative to baseboards because such a uniformity of edges of the papers would determine workmanship of the interior finish work. In the event that one vertical edge of a wall paper precedingly attached to a wall is slightly extended over another wall perpendicular thereto so as to overlap a wall paper to be attached to the second wall, aesthetical interior finish cannot be expected unless the vertical edge is uniformly cut or trimmed.

In order to uniformly cut or trim the edges of wall papers in applying them to walls, cutting lines in the edges of the papers on baseboards have been determined with the aid of rulers or the like. Such a method was troublesome and often caused to cut lines deviated from correct lines.

SUMMARY OF THE INVENTION

It is a principal object of the invention to provide an improved cutter for wall papers, which solves the above problems in attaching wall papers to walls and which is able to uniformly cut or trim edges of the papers utilizing the walls themselves as rulers without using conventional rulers needed in the prior art.

A cutter for wall papers according to the invention comprises a sheath receiving an exchangeable cutting blade slidably therein so as to extend and retract its cutting tip from and into said sheath, and a grip for holding said sheath embedded therein and substantially triangular whose base defines a slide edge extending at a relatively small acute angle with a cutting edge of said cutting blade and having a V-shaped cross-section symmetrical with respect to a phantom plane containing said cutting edge of said cutting blade.

In a preferred embodiment of the invention, the grip is provided at a rear end opposite to the cutting tip with pusher edge means in the form of a spatula for snugly attaching a protruding edge of the wall paper over a baseboard by pushing and sliding the pusher edge means along a boundary between a wall and the baseboard.

In another preferred embodiment of the invention, the grip is formed in the slide edge with a notch near at a rear end opposite to the cutting tip, and is provided in the notch with a frustoconical roller freely rotatable therein and slightly extending on both sides of the slide edge, thereby reducing sliding resistance of the slide edge.

The invention will be more fully understood by referring to the following detailed specification and claims taken in connection with the appended drawings.

DETAILED DESCRIPTION OF THE PREFERRED EMBODIMENT

Figure 1:
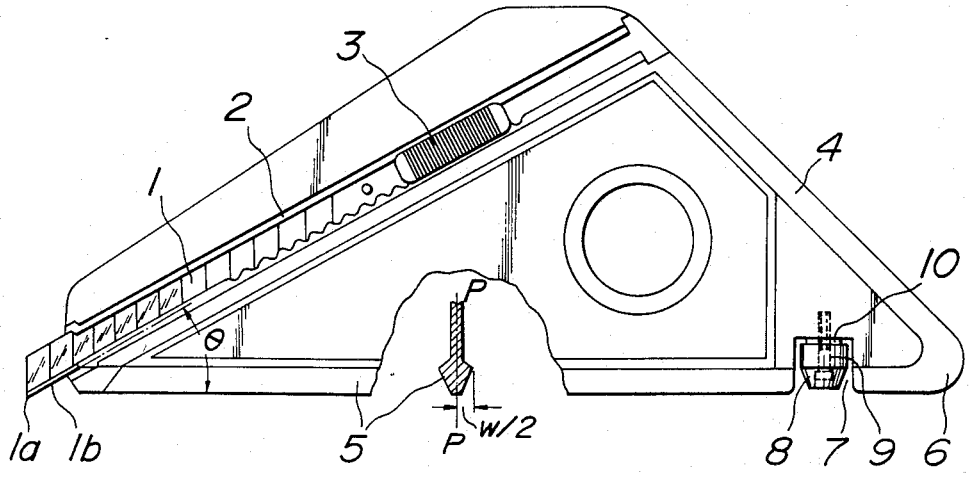
FIG. 1 is a side view of a cutter according to the invention.
Figure 2:
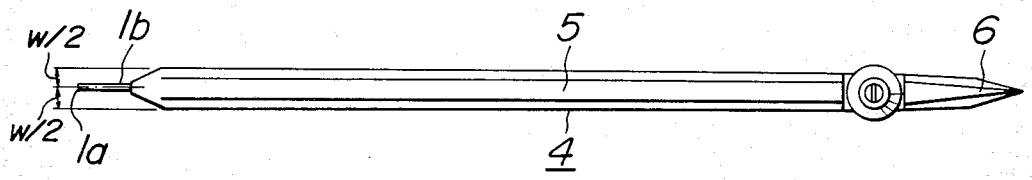
FIG. 2 is a bottom plan view of the cutter shown in FIG. 1.

Referring to FIGS. 1 and 2 illustrating a preferred embodiment of the cutter according to the invention, the cutter comprises an exchangeable cutting blade 1, a sheath 2 for slidably receiving the cutting blade 1 whose cutting tip 1*a* is extensible from and retractable into the sheath 2, a slider 3 slidable in the sheath with frictional resistance, shown in detail in FIGS. 4*a*–4*d*, and a grip 4 having a substantially triangular external appearance and in this embodiment, made of an injection molded synthetic resin.

The grip 4 has a slide edge 5 constituting a base of the above triangle, having a V-shaped cross-section symmetrical with respect to a plane P-P containing a cutting edge 1*b* of the blade 1 and extending in a direction at a relatively small acute angle $\theta$, such as not more than 40°, preferably not more than 30° with the cutting edge 1*b*. The sheath 2 is preferably joining to the grip 4 by injection molding of the latter about sheath 2. However, the sheath 2 may be tightly fitted in a groove corresponding to its outer configuration previously formed in the grip 4.

The slide edge 5 of the grip 4 is further provided at a rear end opposite to the cutting tip 1*a* with a pusher edge 6 in the form of a metal spatula integrally formed therewith. Moreover, the slide edge 5 is preferably formed near the pusher edge with a notch 7 receiving a frustoconical roller 8 slightly extending on both sides of the slide edge 5 and rotatably supported therein by means of a pin 9 with a washer 10 arranged between the roller 8 and the grip 4, whose function will be explained later.

As can be seen in the drawings, the grip 4 is triangular in a side view, so that it can be securely gripped in one hand of a user with one side of the triangle abutting against a palm of the hand.

Figure 3A:
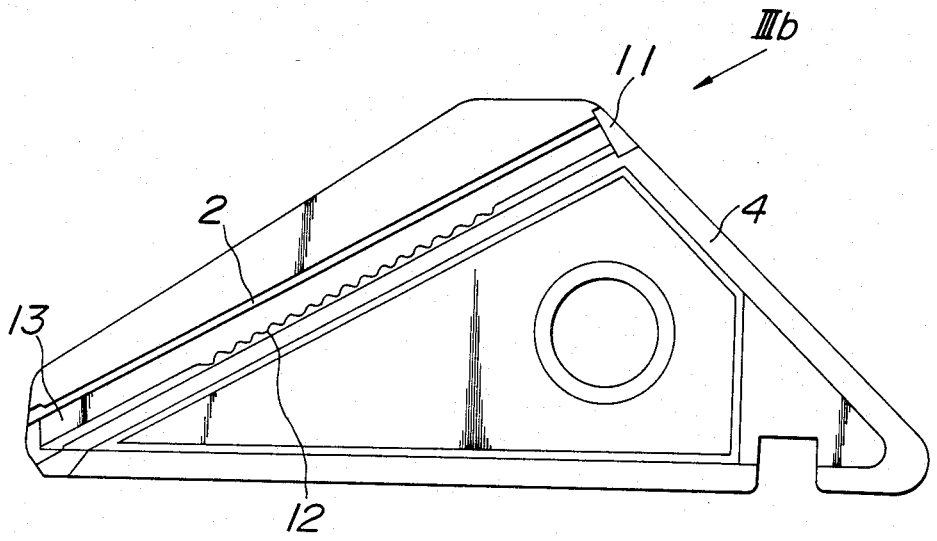
FIG. 3*a* is a side view of the grip and sheath shown in FIG. 1.
Figure 3B:
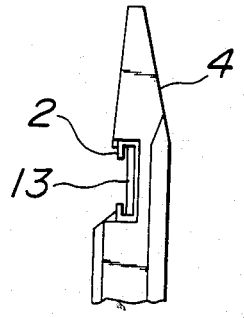
FIG. 3*b* illustrates a part of the grip with the sheath as viewed in the direction of an arrow III*b* in FIG. 3*a;*
Figure 4A:
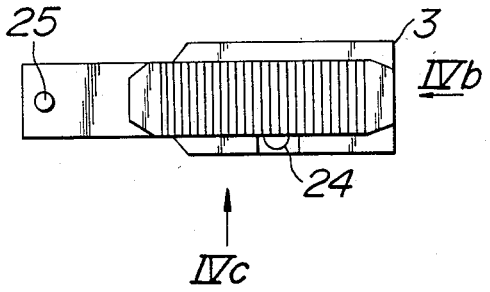
FIGS. 4*a*–4*d* illustrate the slider in detail shown in FIG. 1.
Figure 4B:
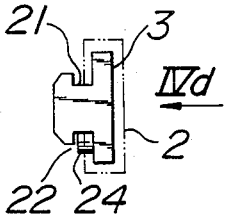
Figure 4C:
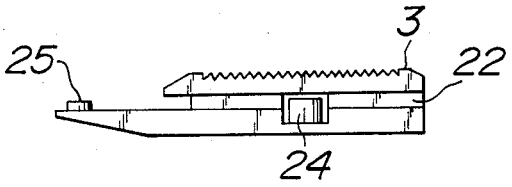
Figure 4D:
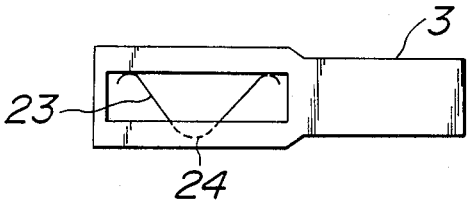

FIGS. 3*a* and 3*b* illustrate the grip 4 and the sheath 2 after having removed the slider 3 and the cutting blade 1. As shown in the drawings, the sheath 2 is formed by a thin elongated sheet metal in the form of a channel whose opposite legs are bent toward each other to form longitudinal edges, one of which is formed with serrations 12 for positioning the cutting blade 1 which will be explained in more detail later. In order to snugly hold a front end of the cutting blade 1, a bottom of a groove of the sheath at a front end is inclined to render the groove more shallow, as shown at 13.

Figure 5:
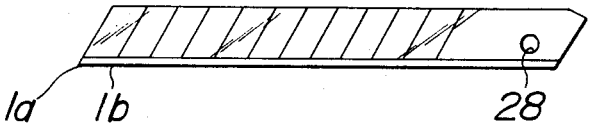
FIG. 5 is a side view of the cutting blade shown in FIG. 1.

FIGS. 4*a*–4*d* show the slider 3 in detail. The slider 3 is formed with grooves 21 and 22 slidably fitted with the sheath (phantom lines) 2 in FIG. 4*b*. As clearly shown in FIG. 4*d*, a leaf spring 23 is arranged in a recess of the slider 3 so as to extend its intermediate portion 24 into the groove 22 of the slider 3. The semicircular intermediate portion 24 of the leaf spring 23 snappedly engages one of the serrations 12 of the sheath with a snap action so as to position the slider 3 and hence the cutting blade 1 depending upon a desired extending distance of the tip 1*a* of the cutting blade 1 from the grip 4. A protrusion 25 of the slider 3 engages in an aperture 28 (FIG. 5) of the cutting blade 1 for connecting it to the slider 3.

In use, a wall paper (not shown) which is slightly longer than a wall is attached to the wall in a conventional manner. A protruding edge of the wall paper extends over along a baseboard, plinth or skirting. The pusher edge 6 of the cutter is urged against the wall paper along a boundary between the wall surface and the baseboard and then moved along the boundary so as to attach the wall paper to the boundary corner snugly. Thereafter, the protruding edge of the wall paper extending over the baseboard is cut or trimmed with a cutting tip 1*a* of the blade 1 extending slightly beyond a prolongation line of the slide edge 5 as shown in FIG. 1 by a sliding movement of the slide edge 5 along the wall surface. In this manner, the edge of the wall paper on the base board is cut to a uniform width with ease by suitably setting inclined angles of the phantom plane P-P relative to the wall surface. The maximum width of the edge of the wall paper on the baseboard is of course w/2. In the illustrated embodiment, the sliding resistance of the slide edge 5 can be reduced by rolling of the frustoconical roller 8, thereby performing smooth cutting.

As can be seen from the above explanation, even in the event of corners or bottoms of grooves difficult for using rulers or the like, only the sliding movement of the slide edge of the grip along a wall surface uniformly cuts an edge of a wall paper on a baseboard to achieve aesthetical interior finish. As the depth of cut of the cutting tip of a blade is maintained at a constant value throughout its cutting step, there is no risk of unintentionally cutting baseboards and distal ends or damaging the cutting tip of the blade. Moreover, in case that vertical edges of wall papers one upon the other attached to a wall are simultaneously cut, the cutter according to the invention can of course be advantageously used with the aid of a ruler or the like along which the slide edge of the cutter is slid.

The cutter according to the invention can achieve the uniform cutting or trimming of overlapped portions of wall papers on baseboards or edges of bases with ease without requiring rulers. Such a trimming determines the workmanship of interior finish work in attaching wall papers onto walls and is very difficult with the prior art. Particularly, the grip of the cutter according to the invention is adapted to be securely gripped by a hand and is able to suitably adjust a width of an overlapped portion of a wall paper on a baseboard by selectively setting an inclined angle of the grip relative to a wall surface.

While the invention has been particularly shown and described with reference to preferred embodiments thereof, it will be understood by those skilled in the art that the foregoing and other changes in form and details can be made therein without departing from the spirit and scope of the invention.

What is claimed is:

1. A cutter for wall papers comprising a sheath receiving an exchangeable cutting blade slidably therein so as to extend and retract its cutting tip from and into said sheath, and a grip for holding said sheath embedded therein and substantially triangular whose base is its longest edge and defines a slide edge extending at a relatively small acute angle with a cutting edge of said cutting blade and having a V-shaped cross-section symmetrical with respect to a phantom plane containing said cutting blade extending slightly beyond a line of prolongation of said slide edge, said grip being formed in said slide edge with a notch near a rear end opposite to said cutting tip, and a frusto-conical roller freely rotatable in said notch and slightly extending on both sides of the slide edge, thereby reducing sliding resistance of the slide edge.

2. A cutter as set forth in claim 1, wherein said grip is provided at a rear end opposite to said cutting tip with pusher edge means in the form of a spatula for snugly attaching a protruding edge of the wall paper over a baseboard by pushing and sliding said pusher edge means along a boundary between a wall and said baseboard.

3. A cutter as set forth in claim 2, wherein said pusher edge means is formed integrally with said grip.

4. A cutter as set forth in claim 1, wherein said roller comprises a frustoconical portion and a cylindrical portion rotatably supported on a pin centrally passing therethrough.

5. A cutter as set forth in claim 1, wherein said acute angle is not more than 40°.

6. A cutter as set forth in claim 1, wherein said sheath is formed by a thin elongated sheet metal in the form of a channel whose opposite legs are bent toward each other to form longitudinal edges, one of which is formed with serrations for positioning said cutting blade.

7. A cutter as set forth in claim 6, wherein said groove of the sheath is shallower at its front end near said cutting tip of the blade, than at its end remote from said cutting tip, to snugly hold the cutting tip.

8. A cutter as set forth in claim 7, wherein there is provided a slider formed with grooves slidably fitting with said longitudinal edges of said sheath and with a protrusion engaging in an aperture formed in said cutting blade for connecting said slider and said cutting blade and is provided with a leaf spring located in a recess formed in the slider and partially extending into one of the grooves of the slider so as to engage with a snap action, said one of said serrations of said sheath for positioning the cutting blade.

* * * * *